US010675550B2

(12) United States Patent
Golliher

(10) Patent No.: US 10,675,550 B2
(45) Date of Patent: Jun. 9, 2020

(54) METHODS AND APPARATUS FOR LAUNCHING PROJECTILES

(71) Applicant: Idea Vault Holdings Inc., Ashland, OR (US)

(72) Inventor: Clayton Golliher, Tujunga, CA (US)

(73) Assignee: Idea Vault Holdings Inc., Ashland, OR (US)

( * ) Notice: Subject to any disclaimer, the term of this patent is extended or adjusted under 35 U.S.C. 154(b) by 0 days.

(21) Appl. No.: 16/423,744

(22) Filed: May 28, 2019

(65) Prior Publication Data

US 2020/0038769 A1 Feb. 6, 2020

Related U.S. Application Data

(60) Provisional application No. 62/677,096, filed on May 28, 2018.

(51) Int. Cl.
*A63H 27/14* (2006.01)

(52) U.S. Cl.
CPC ..... *A63H 27/14* (2013.01)

(58) Field of Classification Search
CPC ..... A63H 27/005; A63H 27/14; F41B 11/00
See application file for complete search history.

(56) References Cited

U.S. PATENT DOCUMENTS 2,443,299 A 6/1948 Brown
2,841,084 A 7/1958 Carlisle
2,993,297 A 7/1961 Bednar
3,022,597 A 2/1962 Rucker
3,029,704 A 4/1962 Truax
3,396,311 A 8/1968 Maltner
3,465,472 A 9/1969 Novotny
3,943,656 A * 3/1976 Green ..... A63H 27/06 446/52
3,962,818 A 6/1976 Pippin
4,159,705 A 7/1979 Jacoby
5,653,216 A 8/1997 Johnson
6,315,629 B1 11/2001 Jones
6,321,737 B1 11/2001 Johnson
6,460,531 B1 10/2002 Gourley
6,679,155 B1 * 1/2004 Yaschur ..... F41A 1/04 124/56
6,820,840 B2 * 11/2004 Lund ..... A63H 27/005 124/71
6,926,579 B2 8/2005 Rappaport
(Continued)

*Primary Examiner* — John A Ricci
(74) *Attorney, Agent, or Firm* — Oppedahl Patent Law Firm LLC

(57) ABSTRACT

A projectile launching apparatus and methods for use with an aerosol spray device containing a flammable liquid. The apparatus comprising a chamber and a tube, the tube fixedly attached to an opening in the chamber. Inside the chamber is a spark gap connected by an electrical cable to a spark power source, the cable having sufficient length to permit the spark power source to be located away from the chamber. A method comprising the steps of sliding the projectile over the tube; spraying some of the flammable liquid into the chamber; activating the spark power source, thereby igniting the mixture of air and flammable liquid, the ignition of the mixture of air and flammable liquid thereby propelling the projectile rapidly away from the projectile launcher apparatus.

17 Claims, 3 Drawing Sheets

(56) References Cited

U.S. PATENT DOCUMENTS

| | | | | |
|---|---|---|---|---|
| 6,945,495 | B1 | 9/2005 | Lund | |
| 7,537,508 | B1 * | 5/2009 | Picone | A63H 27/005 124/65 |
| 7,601,046 | B2 | 10/2009 | Chang | |
| 2005/0009440 | A1 | 1/2005 | Foster | |
| 2005/0085153 | A1 | 4/2005 | Rappaport | |
| 2009/0104839 | A1 | 4/2009 | Chang | |

* cited by examiner

Step 101

If a projectile is present on the tube, remove the projectile from the tube

Step 102

Use the air pump to pump air into the chamber

Step 103

Slide the projectile over the tube

Step 104

Spray some of the flammable liquid from the aerosol spray device into the chamber Step 105

Point the launcher apparatus and projectile in desired non-downwards direction

Step 106

Activate the spark power source, triggering a reaction in the chamber which propels the projectile away from the launcher apparatus

Fig. 2

Step 201

If a projectile is present on the tube, remove the projectile from the tube

Step 202

Use the air pump to pump air into the chamber

Step 203

Slide the projectile over the tube

Step 204

Spray some of the flammable liquid from the aerosol spray device into the chamber Step 205

Remove the projectile from the tube

Step 206

Use the air pump to pump air into the chamber to expel some of the mixture of air and atomized flammable liquid out of the chamber

Fig. 3

METHODS AND APPARATUS FOR LAUNCHING PROJECTILES

CROSS-REFERENCE TO RELATED APPLICATIONS

U.S. provisional patent application No. 62/677,096 filed May 28, 2018 is incorporated by reference in its entirety for all purposes.

BACKGROUND

The disclosed methods and apparatus generally relate to toy and model projectile launchers using an aerosol spray device containing a flammable liquid.

For many years toy launching devices have been popular among children of all ages. One method of launching projectiles has relied on the use of solid-fuel rocket engines. However, many dangers exist when solid-fuel engines are used. For example, in a solid-fuel rocket, once the fuel is ignited it generally will not stop until the entire fuel supply is spent.

Other projectile launchers employ a pressure tank in which pressurized air or water is stored and later expelled through a nozzle as a means to propel the projectile. However, once these types of launchers are fully pressurized they generally cannot be removed from the launcher without firing the projectile, and a pressurized container can burst and be dangerous.

BRIEF SUMMARY OF THE DISCLOSURE

In the methods and apparatus disclosed herein, a projectile launcher is described that can be used to safely and repeatably launch projectiles very fast and very high into the air.

The apparatus uses an aerosol spray device containing a flammable liquid. The apparatus comprises a chamber and a tube, wherein the tube is fixedly attached to an opening in the chamber. Inside the chamber is a spark gap connected by an electrical cable to a spark power source. The cable has sufficient length to permit the spark power source to be located a safe distance away from the chamber and projectile.

A projectile can be slid over the tube. Flammable liquid from the aerosol device is then sprayed into the chamber. When the spark power source is activated by a user, the mixture of air and flammable liquid ignites.

The ignition of the mixture of air and flammable liquid thereby propels the projectile rapidly away from the projectile launcher apparatus.

Safety mechanisms prevent over-pressurization of the chamber and prevent improper fuel sources from being used. The launcher apparatus also allows for a launch to be safely aborted without having to launch the projectile.

BRIEF DESCRIPTION OF THE FIGURES

FIG. 2 is a flowchart of a first method for use with an aerosol spray device and projectile launcher apparatus with a projectile according to an embodiment of the present disclosure.

FIG. 3 is a flowchart of a second method for use with an aerosol spray device and projectile launcher apparatus with a projectile according to an embodiment of the present disclosure.

DETAILED DESCRIPTION OF THE DISCLOSURE

Figure 1:
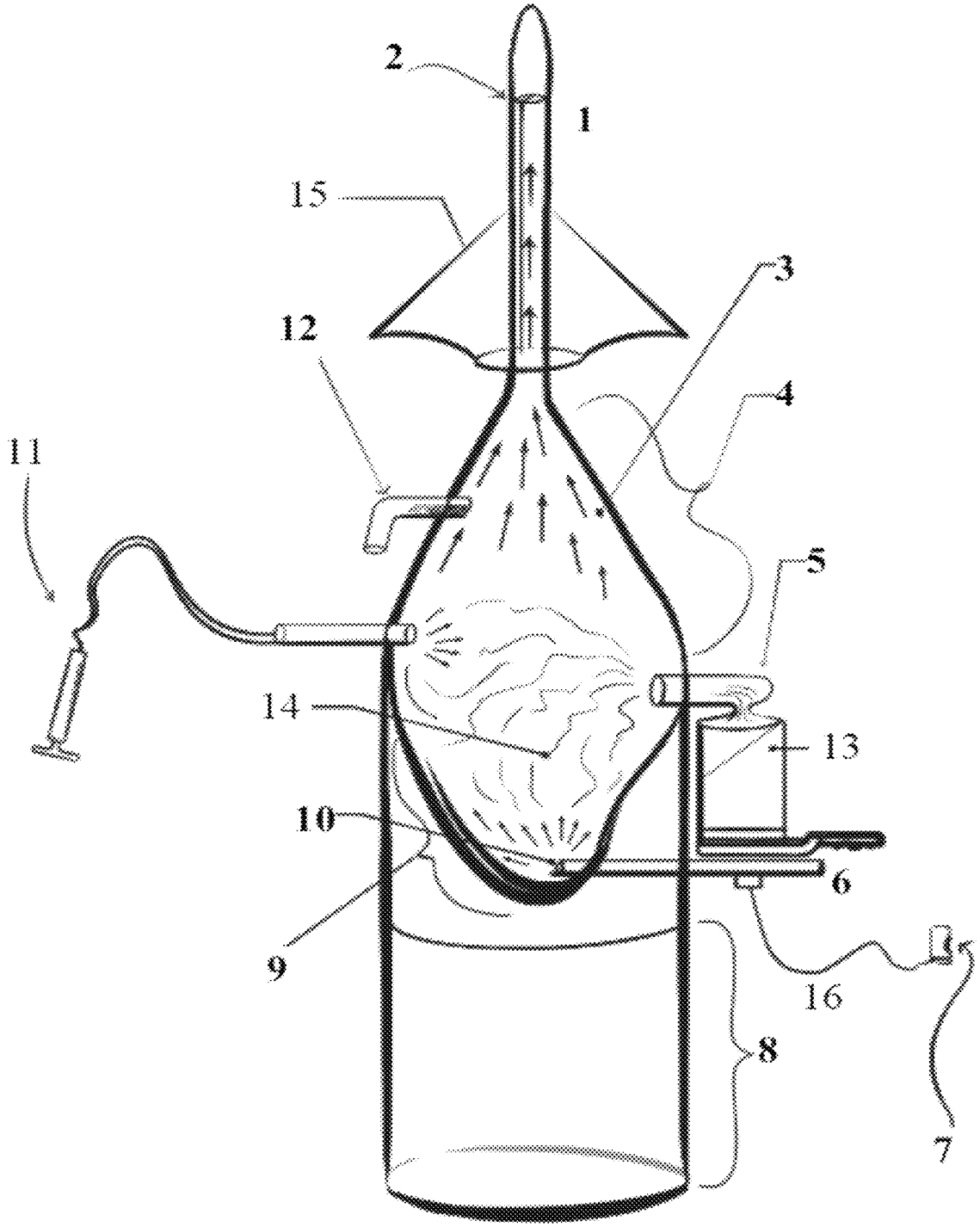
FIG. 1 depicts a projectile launcher apparatus according to an embodiment of the present disclosure.

Disclosed is a projectile launcher apparatus as shown in an embodiment in FIG. 1. The projectile launcher apparatus utilizes an aerosol spray device (13) containing a flammable liquid as the propellant to launch a projectile (15).

The apparatus includes a chamber (3) and a tube (1). The tube (1) has an open bottom end and an open top end. The open bottom end of the tube (1) is fixedly attached to an opening in the chamber (3). It will be appreciated that the tube (1) has a generally constant cross section. The open top end of the tube (1) has a screen (2) there-across to prevent undesired foreign objects and fuels from entering the tube (1).

The chamber (3) has a volume of at least one liter and in an embodiment it may have a conically-shaped top end (4) and a conically-shaped bottom end (9). The chamber (3) is located above the launcher apparatus base (8). The chamber (3) has an input port (5) configured to connect to an aerosol spray device (13) allowing the chamber (3) to be filled with flammable liquid, thereby yielding a mixture of air and atomized flammable liquid (14) in the chamber (3). The chamber (3) is also configured to include a pressure relief valve (12), designed to prevent over-pressurization of the chamber (3). In an embodiment an air pump (11) is connected to the chamber (3) to pump air into the chamber (3). This can flush out old or burnt propellant.

The shape of the lower chamber (9) acts as an upside-down rocket nose and it amplifies the pressure causing increased efficiency and the rocket or projectile to go higher. The shape of the upper chamber (4) causes the pressure to be consolidated by focusing the pressure into an upside-down funnel. This also magnifies, focuses and amplifies pressure which causes the rocket to go higher.

Inside the chamber (3) is a spark gap (10). The spark gap (10) is connected by an electrical cable (16) containing at least two electrical wires to a power source (7). The cable (16) has sufficient length to permit the spark power source (7) to be a safe distance away, for example at least three feet away, from the chamber (3) and the projectile (15). The spark power source (7) may be activated to trigger the spark gap (10), for example by using a switch or a button.

The projectile (15) has a closed top end and an open bottom end, and is shaped to fit in a slidable way over the tube (1).

In an embodiment an activating device (6), such as a lever, is included in the apparatus to manipulate the aerosol spray device (13) containing a flammable liquid in a controlled manner such that the chamber (3) is filled with some of the flammable liquid.

In an embodiment the input port (5) configured to connect to the aerosol spray device (13) has a specially keyed nozzle. In this embodiment the specially keyed nozzle will only connect to a specific aerosol spray device (13).

In an embodiment the flammable liquid is comprised of hydrotreated light distillates (petroleum), butane, hydrofluorocarbon 152a, propane, fragrance, isobutane, and amyl cinnamal.

In an embodiment the projectile launcher apparatus of FIG. 1 may be used as shown in FIG. 2. This may include the step of removing a projectile (15) from the tube (1) if a projectile (15) is present (Step 101).

The air pump (11) may then be used to pump air into the chamber (3) (Step 102), thereby expelling some residual propellant, for example residual propellant from a previous launch or a failed launch or an aborted launch.

The projectile (15) may then be placed back on the tube (1) (step 103).

Some flammable liquid from the aerosol spray device (13) may then be sprayed into the chamber (3), for example by using an aerosol spray device activator (6), thereby yielding a mixture of air and atomized flammable liquid (14) in the chamber (3) (Step 104).

The projectile apparatus and projectile (15) may then be pointed in a desired direction that is not downwards (Step 105).

Multiple chambers can be stacked and fueled separately. This can greatly increase pressure and volume of reaction, to launch much bigger projectiles with heavier payloads.

The spark power source (7) may then be activated, for example by using a switch (Step 106), thereby giving rise to a spark across the spark gap (10). This ignites the mixture of air and atomized flammable liquid (14), thereby causing a rapid expansion of exhaust gas in the chamber (3). Some of the exhaust gas then passes rapidly out the tube (1), thereby propelling the projectile (15) rapidly away from the projectile launcher apparatus.

In an embodiment the projectile launcher apparatus of FIG. 1 may be used as shown in FIG. 3, for example to safely abort a launch attempt. This may include the step of removing a projectile (15) from the tube (1) if a projectile (15) is present (Step 201).

The air pump (11) may then be used to pump air into the chamber (3) (Step 202), thereby expelling some residual or burnt propellant, for example residual propellant from a previous launch or a failed launch or an aborted launch.

The projectile (15) may then be placed back on the tube (1) (step 203).

Some flammable liquid from the aerosol spray device (13) may then be sprayed into the chamber (3), for example by using an aerosol spray device activator (6), thereby yielding a mixture of air and atomized flammable liquid (14) in the chamber (3) (Step 204).

To abort the launch attempt the projectile (15) may then be removed from the tube (1) (Step 205).

The air pump (11) may then be used to pump air into the chamber (3) (Step 206), thereby expelling some of the mixture of air and atomized flammable liquid (14) out of the chamber (3).

The above-described apparatus and methods for using the apparatus allow for safe, repeatable, and fun projectile launches.

Those skilled in the art will have no difficulty devising obvious variants and improvements of the disclosure described above, all of which are intended to be encompassed within the scope of the patent application.

The invention claimed is:

1. A method for use with an aerosol spray device containing a flammable liquid, and with a projectile launcher apparatus and with a projectile, the projectile having a closed top end and an open bottom end, the projectile launcher apparatus comprising a chamber and a tube, the tube having an open bottom end and an open top end, the open bottom end of the tube fixedly attached to an opening in the chamber, the tube having a generally constant cross section, the open top end of the tube having a screen or blocking bar there-across, the chamber having an input port configured to connect to the aerosol spray device, the chamber having a pressure relief valve, the chamber having a spark gap inside the chamber, the spark gap connected by an electrical cable containing at least two electrical wires to a spark power source, the cable having sufficient length to permit the spark power source to be at least three feet away from the chamber and the projectile; the projectile shaped to fit in a slidable way over the tube;

the chamber having a volume of at least one liter;

the method comprising the steps of:

sliding the projectile over the tube;

spraying some of the flammable liquid into the chamber, thereby yielding a mixture of air and atomized flammable liquid in the chamber;

pointing the projectile and the tube in a direction that is not downwards;

activating the spark power source, thereby giving rise to a spark across the spark gap, thereby igniting the mixture of air and atomized flammable liquid, the ignition of the mixture of air and atomized flammable liquid giving rise to a rapid expansion of exhaust gas, some of the exhaust gas passing rapidly out of the tube, thereby propelling the projectile rapidly away from the projectile launcher apparatus.

2. The method of claim 1 wherein the projectile launcher apparatus further comprises an air pump connected to the chamber, and wherein before the step of sliding the projectile over the tube the air pump is used to pump air into the chamber.

3. The method of claim 1 wherein the projectile launcher apparatus further comprises an activating device, and wherein the spraying step comprises using the activating device to manipulate the aerosol spray device.

4. The method of claim 1 further characterized in that the chamber has a top conically-shaped end and a bottom conically-shaped end.

5. The method of claim 1 further characterized in that the flammable liquid is comprised of hydrotreated light distillates (petroleum), butane, hydrofluorocarbon 152a, propane, fragrance, isobutane, and amyl cinnamal.

6. A method for use with an aerosol spray device containing a flammable liquid, and with a projectile launcher apparatus and with a projectile, the projectile having a closed top end and an open bottom end, the projectile launcher apparatus comprising a chamber and a tube, the tube having an open bottom end and an open top end, the open bottom end of the tube fixedly attached to an opening in the chamber, the tube having a generally constant cross section, the open top end of the tube having a screen or blocking bar there-across, the chamber having an input port configured to connect to the aerosol spray device, the chamber having a pressure relief valve, the chamber having a spark gap inside the chamber, the spark gap connected by an electrical cable containing at least two electrical wires to a spark power source, the cable having sufficient length to permit the spark power source to be at least three feet away from the chamber and the projectile; the projectile shaped to fit in a slidable way over the tube;

the chamber having a volume of at least one liter;

the method comprising the steps of:

sliding the projectile over the tube;

spraying some of the flammable liquid into the chamber, thereby yielding a mixture of air and atomized flammable liquid in the chamber;

removing the projectile from the tube;

using an air pump to pump air into the chamber, thereby expelling some of the mixture of air and atomized flammable liquid out of the chamber.

7. The method of claim 6 wherein before the step of sliding the projectile over the tube the air pump is used to pump air into the chamber.

8. The method of claim 6 wherein the projectile launcher apparatus further comprises an activating device, and wherein the spraying step comprises using the activating device to manipulate the aerosol spray device.

9. The method of claim 6 further characterized in that the flammable liquid is comprised of hydrotreated light distillates (petroleum), butane, hydrofluorocarbon 152a, propane, fragrance, isobutane, and amyl cinnamal.

10. A projectile launcher apparatus for use with an aerosol spray device containing a flammable liquid, and for use with a projectile, the projectile launcher apparatus comprising a chamber and a tube, the tube having an open bottom end and an open top end, the open bottom end of the tube fixedly attached to an opening in the chamber, the tube having a generally constant cross section, the open top end of the tube having a screen or blocking bar there-across, the chamber having an input port configured to connect to the aerosol spray device, the chamber having a pressure relief valve, the chamber having a spark gap inside the chamber, the spark gap connected by an electrical cable containing at least two electrical wires to a spark power source, the cable having sufficient length to permit the spark power source to be at least three feet away from the chamber and the projectile; the chamber having a volume of at least one liter.

11. The projectile launcher apparatus of claim 10 further comprising a projectile, the projectile having a closed top end and an open bottom end, the projectile shaped to fit in a slidable way over the tube.

12. The projectile launcher apparatus of claim 10 further comprising an air pump to pump air into the chamber.

13. The projectile launcher apparatus of claim 10 further characterized in that the chamber has a top conically-shaped end and a bottom conically-shaped end.

14. The projectile launcher apparatus of claim 10 further comprising an activating device to manipulate the aerosol spray device containing a flammable liquid in a controlled manner such that the chamber is filled with some of the flammable liquid.

15. The projectile launcher apparatus of claim 14 wherein the activating device is a lever.

16. The projectile launcher apparatus of claim 10 wherein the input port configured to connect to the aerosol spray device has a nozzle, characterized in that the aerosol spray device and the input port nozzle are keyed such that only a specific aerosol spray device will connect to the input port nozzle.

17. The projectile launcher apparatus of claim 10 further characterized in that the flammable liquid is comprised of hydrotreated light distillates (petroleum), butane, hydrofluorocarbon 152a, propane, fragrance, isobutane, and amyl cinnamal.

* * * * *